United States Patent [19]

Borneman et al.

[11] Patent Number: 4,461,811

[45] Date of Patent: Jul. 24, 1984

[54] STABILIZED FERRITIC STAINLESS STEEL WITH IMPROVED BRAZEABILITY

[75] Inventors: Paul R. Borneman; George Aggen, both of Sarver, Pa.

[73] Assignee: Allegheny Ludlum Steel Corporation, Pittsburgh, Pa.

[21] Appl. No.: 402,386

[22] Filed: Jul. 27, 1982

Related U.S. Application Data

[63] Continuation of Ser. No. 176,324, Aug. 8, 1980, abandoned.

[51] Int. Cl.[3] ..... C22C 38/28

[52] U.S. Cl. ..... 428/677; 75/126 F; 148/37; 228/263.15

[58] Field of Search ..... 75/126 F, 126 C; 148/37, 135, 12 EA; 228/263.15; 428/677

[56] References Cited

U.S. PATENT DOCUMENTS

| | | | |
|---|---|---|---|
| 2,891,859 | 6/1959 | Kegerise | 148/37 |
| 2,965,479 | 12/1960 | Evans | 75/126 |
| 3,250,611 | 5/1966 | Lula et al. | 75/126 |
| 3,373,015 | 3/1968 | Allen et al. | 148/37 |
| 3,997,373 | 12/1976 | Kazeva | 75/126 F |
| 4,222,771 | 9/1980 | Oda et al. | 148/37 |

FOREIGN PATENT DOCUMENTS

| | | | |
|---|---|---|---|
| 638110 | 5/1950 | United Kingdom | 148/37 |

*Primary Examiner*—Peter K. Skiff

*Attorney, Agent, or Firm*—Patrick J. Viccaro

[57] ABSTRACT

A stabilized ferritic stainless steel is wettable by brazing materials used at temperatures of from 2000° F. to 2100° F. The steel consists essentially of, by weight, 10.5% to 13.5% chromium, up to 0.1% carbon, up to 0.05% nitrogen, up to about 0.12% titanium and at least one other stabilizing element from the group consisting of niobium and tantalum in an amount in accordance with the relationship:

$$\frac{\frac{\text{Wt \% Nb}}{93} + \frac{\text{Wt \% Ta}}{181} + \frac{\text{Wt \% Ti}}{48}}{\frac{\text{Wt \% C}}{12} + \frac{\text{Wt \% N}}{14}} > 1.$$

17 Claims, No Drawings

STABILIZED FERRITIC STAINLESS STEEL WITH IMPROVED BRAZEABILITY

This is a continuation of application Ser. No. 176,324, filed Aug. 8, 1980, now abandoned.

The invention relates to stabilized ferritic stainless steels and is particularly useful for ferritic stainless steel articles which are joined by brazing.

Ferritic stainless steels possess excellent mechanical properties and oxidation and general corrosion resistance at elevated temperatures. These steels are ideal for use as the structural members of heat exchangers, exhaust systems, chemical process vessels and the like which are exposed to high temperatures and stresses and corrosive environments. Fabrication of these articles frequently requires the joining of the ferritic stainless steel with either itself or with another dissimilar metal at sufficiently high temperatures for the joining method to be effective. Also, generally speaking, the steel must be joined in a temperature range exceeding the anticipated service temperature. Brazing is a widely practiced method of joining metals involving the temperatures of from 800° F. to the 2000° F.-2100° F. range which are above the melting point of the brazing filler material but below the melting point of the base metal being joined. When the temperature of the brazing filler material is about the melting point, it becomes molten and wets the surface of the steel, and then flows by capillary action to fll a joint. Bonding results from the intimate contact produced by the dissolution of a small amount of the base metal in the molten filler metal.

Ferritic stainless steels to be joined at high temperatures contain low levels of carbon and small amounts of stabilizing elements for combining with carbon and nitrogen to maintain the ferritic phase and to maintain the oxidation and corrosion resistance of the steel. Stabilizing elements such as titanium, niobium or tantalum react with the carbon and nitrogen to prevent the formation and precipitation of chromium carbides and nitrides at grain boundaries and the simultaneous depletion of chromium in the surrounding areas. Stabilizing elements must be added in amounts exceeding the theoretical requirement to assure complete stabilization of carbon and nitrogen. Titanium is the preferred stabilizing element because of its very strong affinity for carbon and nitrogen, its low atomic weight and its availability. Other stabilizing agents including niobium and tantalum are not favored because they are more expensive and less effective on a weight basis than titanium and also because they are accompanied by a tendency toward weld cracking problems.

Titanium stabilized ferritic steels known in the prior art (see, e.g., Lula et al. U.S. Pat. No. 3,250,641) cannot be readily brazed with filler materials such as oxygen-free copper and nickel base alloys. These steels form a non-wettable surface film which prevents proper bonding between the ferritic stainless steel base metal and the brazing filler material even when furnace brazing under vacuum or in an inert atmosphere. The oxygen-free copper as a high temperature brazing filler metal does not penetrate this surface film. Nickel alloy high temperature brazing filler metals usually contain boron and silicon additions to penetrate the surface film. Although the steel wettability is improved, these nickel base materials will also penetrate the grain boundaries thereby causing intergranular attack of the base metal. In addition, brazing operations are not aided by increased temperatures or by increased brazing times because the high temperature range is beginning to affect the grain size of the steel and prolonged time tends to increase film resistance. For these reasons, brazing with copper is impossible and brazing with nickel base metals is not consistent enough to be of practical value from a quality assurance viewpoint. Thus copper clad ferritic stainless steels are used in brazing applications when the brazing temperature is to reach 2000° F.-2100° F. In this process, the copper cladding is brazed rather than the steel.

The present invention relates to a stabilized ferritic stainless steel composition which is wettable by conventional brazing materials used at temperatures of from 2000° F.-2100° F. in furnace brazing practices. In accordance with the invention, a ferritic stainless steel consists essentially of, by weight, 10.5% to 13.5% chromium, up to 0.1% carbon, up to 0.5% nitrogen, up to about 0.12% titanium and at least one other stabilizing element from the group consisting of niobium and tantalum in accordance with the relationship:

$$\frac{\frac{\text{Wt \% Nb}}{93} + \frac{\text{Wt \% Ta}}{181} + \frac{\text{Wt \% Ti}}{48}}{\frac{\text{Wt \% C}}{12} + \frac{\text{Wt \% N}}{14}} > 1.$$

The presence of niobium, tantalum and titanium in accordance with this stabilization relationship are sufficient to effectively stabilize the interstitial elements in the steel without forming a non-wettable surface film. The niobium and tantalum are present as additions to the melt. Titanium may be present in the scrap feed or added to the melt. The titanium is responsible for the nature of the film which becomes non-wettable when titanium is present in amounts greater than about 0.12%. Greater amounts of titanium could be tolerated and the effect of titanium on wettability could be neutralized if titanium compounds stable at brazing temperatures such as $TiO_2$, TiS and TiN are permitted to form. However, oxygen, sulfur and nitrogen have an undesirable effect on other steel qualities and generally they will be kept as low as possible. From a brazing viewpoint it is preferable to have a composition free of titanium. For this reason the titanium is preferably present in an amount up 0.01% by weight and, most preferably, up to 0.005%. The steel may also contain up to 0.1% aluminum, up to 1.25% molybdenum, up to 1% manganese and up to 1% silicon to enhance its mechanical and corrosion properties. Articles of this composition are wettable by fillers such as copper, nickel and their alloys and can be successfully furnace brazed according to conventional practices.

In some cases, however, it may be desirable to both weld and braze the same article. Therefore, titanium is tolerated in controlled amounts up to 0.12% to prevent weld cracking while maintaining reasonable wettability during brazing operations. Larger amounts of titanium render the steel unbrazeable for practical purposes.

To illustrate the beneficial results of the invention specimens from sixteen laboratory heats and two commercial heats were tested for wettability. The composition of the laboratory heats and the commercial heats are identified in Table I as Nos. 1-16 and Nos. A and B respectively.

| No. | C | Mn | P | S | Si | Cr | Ni | Al | Mo | Cu | $N_2$ | Ti | Nb | Ta | Stabilization Ratio |
|---|---|---|---|---|---|---|---|---|---|---|---|---|---|---|---|
| 1 | 0.020 | 0.49 | 0.006 | 0.006 | 0.42 | 11.20 | 0.052 | 0.009 | 0.010 | 0.029 | 0.020 | 0.005 | 0.46 | NA | 1.63 |
| 2 | 0.019 | 0.51 | 0.005 | 0.006 | 0.40 | 10.81 | 0.036 | 0.006 | 0.010 | 0.023 | 0.022 | 0.002 | 0.47 | NA | 1.69 |
| 3 | 0.019 | 0.50 | 0.006 | 0.006 | 0.38 | 10.74 | 0.038 | 0.011 | 0.010 | 0.023 | 0.022 | 0.002 | 0.47 | NA | 1.62 |
| 4 | 0.022 | 0.51 | 0.006 | 0.006 | 0.38 | 10.78 | 0.036 | 0.006 | 0.010 | 0.023 | 0.022 | 0.002 | 0.50 | NA | 1.70 |
| 5 | 0.024 | 0.46 | 0.029 | 0.008 | 0.48 | 10.84 | 0.031 | 0.005 | 0.047 | 0.037 | 0.020 | 0.008 | 1.00 | NA | 3.18 |
| 6 | 0.023 | 0.46 | 0.029 | 0.007 | 0.49 | 10.82 | 0.031 | 0.003 | 0.047 | 0.037 | 0.019 | 0.11 | 1.00 | NA | 3.98 |
| 7 | 0.022 | 0.46 | 0.029 | 0.006 | 0.50 | 10.84 | 0.031 | 0.007 | 0.047 | 0.037 | 0.020 | 0.32 | 1.00 | NA | 5.34 |
| 8 | 0.025 | 0.44 | 0.029 | 0.006 | 0.49 | 11.17 | 0.013 | 0.009 | 0.051 | 0.031 | 0.019 | 0.28 | 0.72 | NA | 3.95 |
| 9 | 0.025 | 0.44 | 0.029 | 0.006 | 0.48 | 11.19 | 0.013 | 0.009 | 0.051 | 0.031 | 0.018 | 0.48 | 0.73 | NA | 5.30 |
| 10 | 0.024 | 0.44 | 0.029 | 0.006 | 0.48 | 11.19 | 0.012 | 0.012 | 0.051 | 0.031 | 0.018 | 0.68 | 0.72 | NA | 6.66 |
| 11 | 0.023 | 0.47 | 0.034 | 0.004 | 0.42 | 15.64 | 0.29 | 0.020 | 0.043 | 0.015 | 0.014 | 0.25 | 0.010 | 0.90 | 3.53 |
| 12 | 0.024 | 0.47 | 0.034 | 0.004 | 0.44 | 15.09 | 0.29 | 0.018 | 0.043 | 0.029 | 0.017 | 0.18 | 0.010 | 1.68 | 4.09 |
| 13 | 0.024 | 0.47 | 0.034 | 0.004 | 0.46 | 15.10 | 0.23 | 0.010 | 0.037 | 0.072 | 0.018 | 0.16 | 0.010 | 2.56 | 5.35 |
| 14 | 0.015 | 0.37 | 0.042 | 0.003 | 0.38 | 10.98 | 0.050 | 0.017 | 0.047 | 0.066 | 0.017 | 0.004 | <0.010 | 0.46 | 1.07 |
| 15 | 0.016 | 0.37 | 0.040 | 0.003 | 0.39 | 10.98 | 0.049 | 0.011 | 0.045 | 0.067 | 0.016 | 0.004 | <0.010 | 0.70 | 1.60 |
| 16 | 0.017 | 0.34 | 0.037 | 0.002 | 0.40 | 10.98 | 0.052 | 0.008 | 0.045 | 0.067 | 0.016 | 0.004 | <0.010 | 1.80 | 3.92 |
| A | 0.015 | 0.28 | 0.019 | 0.001 | 0.40 | 11.07 | 0.12 | 0.020 | 0.024 | 0.074 | 0.016 | 0.29 | 0.0016 | NA | 2.53 |
| B | 0.014 | 0.35 | 0.017 | 0.002 | 0.56 | 11.28 | 0.20 | 0.022 | 0.030 | 0.080 | 0.013 | 0.40 | 0.0015 | NA | 3.97 |

NA = Residual Only

Samples from the laboratory heats were hot rolled to about 0.100 inch and cold rolled to 0.020 inch. The commercial samples were also cold rolled to 0.020 inch. The cold rolled samples were then annealed and pickled in accordance with standard practices. Circular specimens of 1½ inch diameter were stamped from the cold rolled strips and tested for brazing wettability in a resistance heated cold wall vacuum furnace.

The test generally consisted of placing a brazing filler material on each specimen and heating the specimens and filler materials to the melting point of the filler material. The wettability of the specimens were evaluated according to the parameter "$d^2/h$", where "d" is the average diameter of the drop in inches which formed on the surface of the specimen and "h" is the height of the drop in inches, wettability being proportional to the area covered by the drop and inversely proportional to the height of the drop.

Specimens of the heats were tested at 2050° F. in conventional furnace atmospheres with oxygen-free copper as a brazing filler material. No flux was applied because this would be an uncommon practice in furnace brazing operations. Short ⅛ inch lengths of 0.010 inch diameter wire with square ends were placed on end at the center of each specimen heated. In vacuum tests, the furnace was evacuated cold, heated to 1050° F., held at a vacuum of one micron of mercury or less while heating to the brazing temperature. In inert gas tests, the furnace was evacuated cold, heated to 1050° F., held at a vacuum of one micron or less while heating to 1200° F., pressurized with nitrogen to 1500 microns and heated to the brazing temperature.

In the reducing atmosphere tests, the furnace was evacuated cold, heated to 1050° F., held at a vacuum of one micron or less while heating to 1200° F., pressurized with dry hydrogen (having a dew point of less than −80° F.) to a pressure of 300,000 microns and heated to the brazing temperature. The wettability ratings ($d^2/h$) of the specimens are shown in Table II. The letter "C" indicates that the specimen was completely wetted.

TABLE II

| No. | DRY $N_2$ ATMOSPHERE | DRY $H_2$ ATMOSPHERE | Vacuum |
|---|---|---|---|
| 1 | C | 4.292 | C |
| 2 | C | 4.836 | C |
| 3 | C | 5.559 | C |

TABLE II-continued

| No. | DRY $N_2$ ATMOSPHERE | DRY $H_2$ ATMOSPHERE | Vacuum |
|---|---|---|---|
| 4 | C | 4.930 | C |
| 5 | 2.040 | 0.721 | 22.003 |
| 6 | 1.836 | 0.182 | 9.840 |
| 7 | 0.286 | 0.174 | 0.296 |
| 8 | 0.304 | 0.199 | 0.325 |
| 9 | 0.253 | 0.187 | 0.256 |
| 10 | 0.228 | 0.171 | 0.178 |
| 11 | — | — | 0.573 |
| 12 | — | — | 0.579 |
| 13 | — | — | 0.568 |
| 14 | — | — | 30.502 |
| 15 | — | — | 24.807 |
| 16 | — | — | C |
| A | 0.896 | 0.207 | 0.586 |
| B | 0.361 | 0.219 | 0.254 |

The wettability of the laboratory melted compositions can be compared with each other and with the prior art compositions of Heats A and B to determine the adverse effects of titanium. The prior art compositions are clearly non-wettable. The stabilized compositions of Heats 1–4 and 14–16 contain up to 0.005 of titanium and exhibit superior wettability under all atmospheres. The effect of increasing amounts of titanium is most clearly shown by the compositions of Heats 5–7. The composition of Heat 5 contains 0.008 wt % titanium and has superior wettability characteristics under all atmospheres. The composition of Heat 6 contains 0.11 wt % titanium and has improved wettability characteristics under inert gas and vacuum atmospheres, however the adverse effect of titanium is evident in a reducing atmosphere. Heats 7–13 contain large amounts of titanium and have no better wettability characteristics than do the prior art compositions.

The difference in wettability between the specimens brazed with oxygen-free copper in a dry nitrogen atmosphere can be seen. Specimens A and B are the commercial steels and illustrate the problem where the filler material does not wet the surface beyond the periphery of the molten drop. Similarly, specimens 7, 8, 9 and 10 are also not wetted by the filler material. Specimens 1, 2, 3 and 4 are completely wetted by the oxygen-free copper. Specimens 5 and 6, although containing increasing titanium concentrations of 0.008% and 0.11% respectively, are clearly wetted by the copper beyond the periphery of the molten drop.

Specimens of the heats were tested at 2000° F. under vacuum conditions with a nickel alloy as a brazing filler material. In these tests nickel alloy powder (AWS BNi-2) was mixed with a plastic cement which vaporized completely before reaching 1000° F. The mixture was formed into pellets of approximately 3/16 inch diameter by 3/16 inch height and the pellets were placed on the specimens. The furnace was evacuated cold and heated to the brazing temperature. No flux was applied because this is uncommon practice in furnace brazing at high temperatures. The wettability ratings of the laboratory melted specimens are shown in Table III. The letter "C" indicates that the specimen was completely wetted.

TABLE III

| Heat | $d^2/h$ |
|---|---|
| 1 | — |
| 2 | — |
| 3 | C |
| 4 | — |
| 5 | C |
| 6 | 35.917 |
| 7 | 5.329 |
| 8 | — |
| 9 | 2.888 |
| 10 | 2.188 |
| 11 | — |
| 12 | 4.929 |
| 13 | — |
| 14 | C |
| 15 | C |
| 16 | C |
| A | — |
| B | — |

The prior art compositions were not tested but they would have a rating approximating those of Heats 7 and 9 respectively in view of their titanium contents. The compositions of Heats 3, 5 and 14–16 all contain less than 0.01 wt % titanium and have superior wettability characteristics. The composition of Heat 6 contains 0.11 wt % titanium and has superior wettability characteristics in comparison to the other compositions containing 0.18 wt % (Heat 12) or more titanium (Heat 7 and 9).

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

What is claimed is:

1. A brazeable ferritic stainless steel consisting essentially of, by weight, 10.5% to 13.5% chromium, up to 0.03% carbon, up to 0.05% nitrogen, up to 0.10% aluminum, up to about 0.12% titanium, up to 0.12% aluminum plus titanium and at least one other stabilizing element selected from the group consisting of niobium and tantalum in an amount in accordance with the relationship $$\frac{\frac{WT\ \%\ Nb}{93} + \frac{WT\ \%\ Ta}{181} + \frac{Wt\ \%\ Ti}{48}}{\frac{WT\ \%\ C}{12} + \frac{WT\ \%\ N}{14}} > 1,$$

the steel being wettable by brazing filler materials.

2. A brazeable ferritic stainless steel consisting essentially of, by weight, 10.5% to 13.5% chromium, up to 0.03% carbon, up to 0.050% nitrogen, u to 0.10% aluminum, up to 1.25% molybdenum, up to 1% manganese, up to 1% silicon, up to about 0.12% titanium, up to 0.12% aluminum plus titanium and at least one other stabilizing element from the group consisting of niobium and tantalum in an amount in accordance with the relationship $$\frac{\frac{WT\ \%\ Nb}{93} + \frac{WT\ \%\ Ta}{181} + \frac{Wt\ \%\ Ti}{48}}{\frac{WT\ \%\ C}{12} + \frac{WT\ \%\ N}{14}} > 1,$$

the steel being wettable by brazing filler materials.

3. A brazeable ferritic stainless steel consisting essentially of, by weight, 10.5% to 13.5% chromium, up to 0.03% carbon, up to 0.03% nitrogen, up to 0.020% aluminum, up to 1% manganese, up to 1% silicon, up to about 0.12% titanium, up to 0.12% aluminum plus titanium and at least one other stabilizing element from the group consisting of niobium and tantalum in an amount in accordance with the relationship $$\frac{\frac{WT\ \%\ Nb}{93} + \frac{WT\ \%\ Ta}{181} + \frac{Wt\ \%\ Ti}{48}}{\frac{WT\ \%\ C}{12} + \frac{WT\ \%\ N}{14}} > 1,$$

the steel being wettable by brazing filler materials.

4. The brazeable ferritic stainless steel of claims 1, 2 or 3 wherein the titanium is present in amounts up to about 0.01%.

5. The brazeable ferritic stainless steel of claims 1, 2 or 3 wherein the titanium is present in amounts up to about 0.005%.

6. The ferritic stainless steel of claims 1, 2 or 3 wherein the titanium is present in amounts of at least 0.001%.

7. The brazeable ferritic steel of claims 1, 2 or 3 stabilized by niobium.

8. The brazeable ferritic steel of claims 1, 2 or 3 stabilized by tantalum.

9. The ferritic stainless steel of claims 1, 2 or 3 wherein the steel is wettable by molten copper.

10. The ferritic stainless steel of claims 1, 2 or 3 wherein the titanium is present in amounts up to about 0.01% and the steel is wettable by molten copper.

11. The ferritic stainless steel of claims 1, 2 or 3 wherein the titanium is present in amounts up to about 0.005% and the steel is wettable by molten copper.

12. A brazed ferritic stainless steel article having the composition of the steel of claims 1, 2 or 3.

13. A ferritic stainless steel article having the composition of the steel of claims 1, 2 or 3 wherein the article is brazed with copper.

14. The brazeable ferritic steel of claims 1, 2, or 3 stabilized with up to 1.0% niobium.

15. The brazeable ferritic steel of claims 1, 2, or 3 stabilized with up to 1.8% tantalum.

16. A method of brazing ferritic stainless steel consisting essentially of, by weight, 10.5% to 13.5% chromium, up to 0.03% carbon, up to 0.05% nitrogen, up to 0.10% aluminum, up to 1.25% molybdenum, up to 1% manganese, up to 1% silicon, up to about 0.12% titanium, up to 0.12% aluminum plus titanium and at least one other stabilizing element from the group consisting of niobium and tantalum in an amount in accordance with the relationship $$\frac{\frac{WT\ \%\ Nb}{93} + \frac{WT\ \%\ Ta}{181} + \frac{Wt\ \%\ Ti}{48}}{\frac{WT\ \%\ C}{12} + \frac{WT\ \%\ N}{14}} > 1,$$

the steel being brazed with a filler material.

17. The method of brazing of claim 16 wherein the filler material is copper.

* * * * *